US011285718B2

(12) United States Patent
Seki et al.

(10) Patent No.: US 11,285,718 B2
(45) Date of Patent: Mar. 29, 2022

(54) LIQUID JET HEAD AND LIQUID JET RECORDING DEVICE

(71) Applicant: SII PRINTEK INC., Chiba (JP)

(72) Inventors: Masatoshi Seki, Chiba (JP); Takanori Koyano, Chiba (JP); Masaru Midorikawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 34 days.

(21) Appl. No.: 16/892,870

(22) Filed: Jun. 4, 2020

(65) Prior Publication Data

US 2020/0384763 A1 Dec. 10, 2020

(30) Foreign Application Priority Data

Jun. 7, 2019 (JP) ..... JP2019-107218

(51) Int. Cl.
*B41J 2/14* (2006.01)

(52) U.S. Cl.
CPC ..... *B41J 2/14* (2013.01)

(58) Field of Classification Search
CPC . B41J 25/001; B41J 2/14; B41J 25/304; B41J 29/38; B41J 2/14024; B41J 2/175
See application file for complete search history.

(56) References Cited

U.S. PATENT DOCUMENTS

2015/0258824 A1* 9/2015 Goren ..... B41J 25/34 347/37

FOREIGN PATENT DOCUMENTS

| | | | |
|---|---|---|---|
| EP | 2918411 | A1 | 9/2015 |
| EP | 3147128 | A1 | 3/2017 |
| EP | 3403837 | A1 | 11/2018 |
| JP | 2011-136507 | A | 7/2011 |
| WO | WO 2015/037529 | A1 | 3/2015 |

OTHER PUBLICATIONS

European Search Report for Europe Application No. 20178571.4, dated Oct. 22, 2020, 12 pages.

* cited by examiner

*Primary Examiner* — Jannelle M Lebron
(74) *Attorney, Agent, or Firm* — Crowell & Moring LLP

(57) ABSTRACT

A liquid jet head and a liquid jet recording device capable of reducing the installation area of the liquid jet head are provided. The liquid jet head according to an embodiment of the present disclosure is to be installed in a carriage of the liquid jet recording device. The liquid jet head includes a jet section provided with a nozzle hole configured to jet liquid, a support member configured to support the jet section, and provided with a hole part including a through hole penetrating in a jet direction of the liquid, a biasing member disposed in the hole part, and configured to bias the support member toward the carriage, and a biased member which is disposed at a predetermined position with respect to the carriage, and is biased in the hole part by the biasing member to thereby set a position of the nozzle hole with respect to the carriage.

9 Claims, 14 Drawing Sheets

LIQUID JET HEAD AND LIQUID JET RECORDING DEVICE

RELATED APPLICATIONS

This application claims priority to Japanese Patent Application No. 2019-107218, filed on Jun. 7, 2019, the entire content of which is incorporated herein by reference.

BACKGROUND OF THE INVENTION

1. Field of the Invention

The present disclosure relates to a liquid jet head and a liquid jet recording device.

2. Description of the Related Art

As one of liquid jet recording devices, there is provided an inkjet type recording device for ejecting (jetting) ink (liquid) on a recording medium such as recording paper to perform recording of images, characters, and so on.

In the liquid jet recording device of this type, it is arranged so that the ink is supplied from an ink tank to an inkjet head (a liquid jet head), and then the ink is ejected from nozzle holes of the inkjet head toward the recording medium to thereby perform recording of the images, the characters, and so on.

The inkjet head is provided with, for example, a nozzle array having a plurality of nozzle holes arranged along a predetermined direction. It is arranged that the nozzle array is disposed at a predetermined position with respect to a carriage in the liquid jet recording device (e.g., JP-A-2011-136507).

In such an inkjet head, it is desired to reduce the area necessary to install the liquid jet head.

Therefore, it is desirable to provide a liquid jet head and a liquid jet recording device capable of reducing the installation area of the liquid jet head.

SUMMARY OF THE INVENTION

The liquid jet head according to an embodiment of the present disclosure is a liquid jet head to be installed in a carriage of a liquid jet recording device, the liquid jet head including a jet section provided with a nozzle hole configured to jet liquid, a support member configured to support the jet section, and provided with a hole part including a through hole penetrating in a jet direction of the liquid, a biasing member disposed in the hole part, and configured to bias the support member toward the carriage, and a biased member which is disposed at a predetermined position with respect to the carriage, and is biased in the hole part by the biasing member to thereby set a position of the nozzle hole with respect to the carriage.

The liquid jet recording device according to an embodiment of the present disclosure includes the liquid jet head according to an embodiment of the present disclosure, and the carriage on which the liquid jet head is mounted.

According to the liquid jet head and the liquid jet recording device related to an embodiment of the present disclosure, it becomes possible to reduce the installation area for the liquid jet head.

DETAILED DESCRIPTION OF THE PREFERRED EMBODIMENTS

An embodiment of the present disclosure will hereinafter be described in detail with reference to the drawings.

1. Embodiment

[Overall Configuration of Printer 1]

Figure 1:
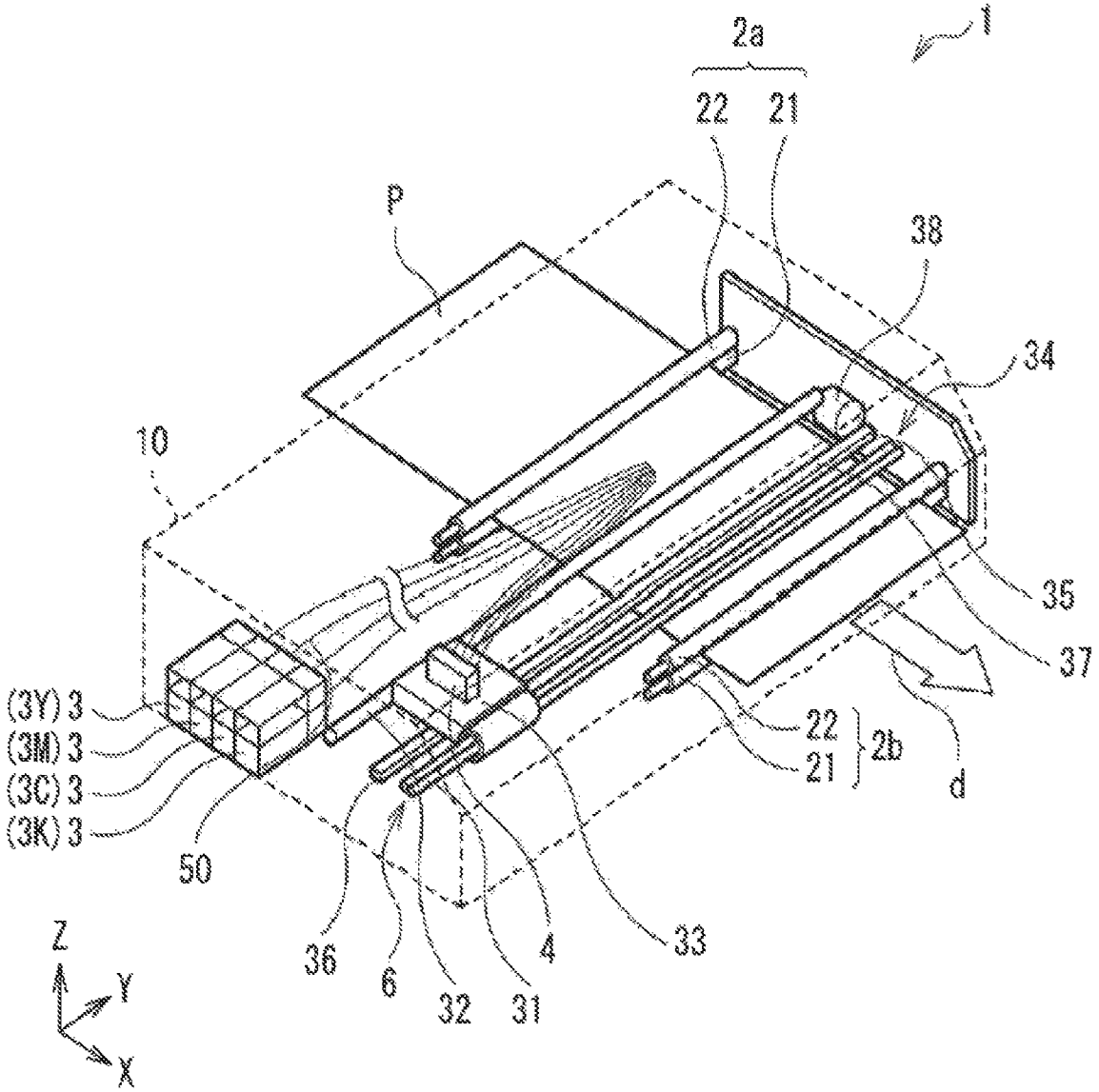
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording medium using ink.

As shown in FIG. 1, the printer 1 is provided with a pair of carrying mechanisms 2*a*, 2*b*, ink tanks 3, inkjet heads 4, supply tubes 50, and a scanning mechanism 6. These members are housed in a housing 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 each correspond to a specific example of the "liquid jet head" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink inside. As the ink tanks 3, there are disposed four types of tanks for individually containing the ink of four colors of yellow (Y), magenta (M), cyan (C), and black (K) in this example as shown in FIG. 1. In other words, there are disposed the ink tank 3Y for containing the yellow ink, the ink tank 3M for containing the magenta ink, the ink tank 3C for containing the cyan ink, and the ink tank 3K for containing the black ink. These ink tanks 3Y, 3M, 3C, and 3K are arranged side by side along the X-axis direction inside the housing 10.

It should be noted that the ink tanks 3Y, 3M, 3C, and 3K have the same configuration except the color of the ink contained, and are therefore collectively referred to as ink tanks 3 in the following description.

(Inkjet Heads 4)

The inkjet heads 4 are each a head for jetting (ejecting) the ink having a droplet shape from a plurality of nozzles 78 described later to the recording paper P to thereby perform recording of images, characters, and so on. The printer 1 is provided with the plurality of inkjet heads 4. For example, the printer 1 is provided with twelve inkjet heads 4 (see FIG. 2 and so on described later). In FIG. 1, there is illustrated one of the inkjet heads 4 for simplification. The arrangement of the plurality of inkjet heads 4 will be described later. For example, it is arranged that each of the inkjet heads 4 is supplied with the ink of one or two of the colors of yellow, magenta, cyan, and black. The number of the inkjet heads 4 provided to the printer 1 can be smaller than twelve, or can also be larger than twelve.

The supply tubes 50 are each a tube for supplying the ink from the inside of the ink tank 3 to the inside of the inkjet head 4.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 31, 32 disposed so as to extend along the Y-axis direction, a carriage 33 movably supported by these guide rails 31, 32, and a drive mechanism 34 for moving the carriage 33 along the Y-axis direction. Further, the drive mechanism 34 has a pair of pulleys 35, 36 disposed between the guide rails 31, 32, an endless belt 37 wound between the pair of pulleys 35, 36, and a drive motor 38 for rotationally driving the pulley 35.

The pulleys 35, 36 are respectively disposed in areas corresponding to the vicinities of both ends in each of the guide rails 31, 32 along the Y-axis direction. To the endless belt 37, there is coupled the carriage 33. This carriage 33 has, for example, a base shaped like a flat plate for mounting the inkjet head described above.

Figure 2:
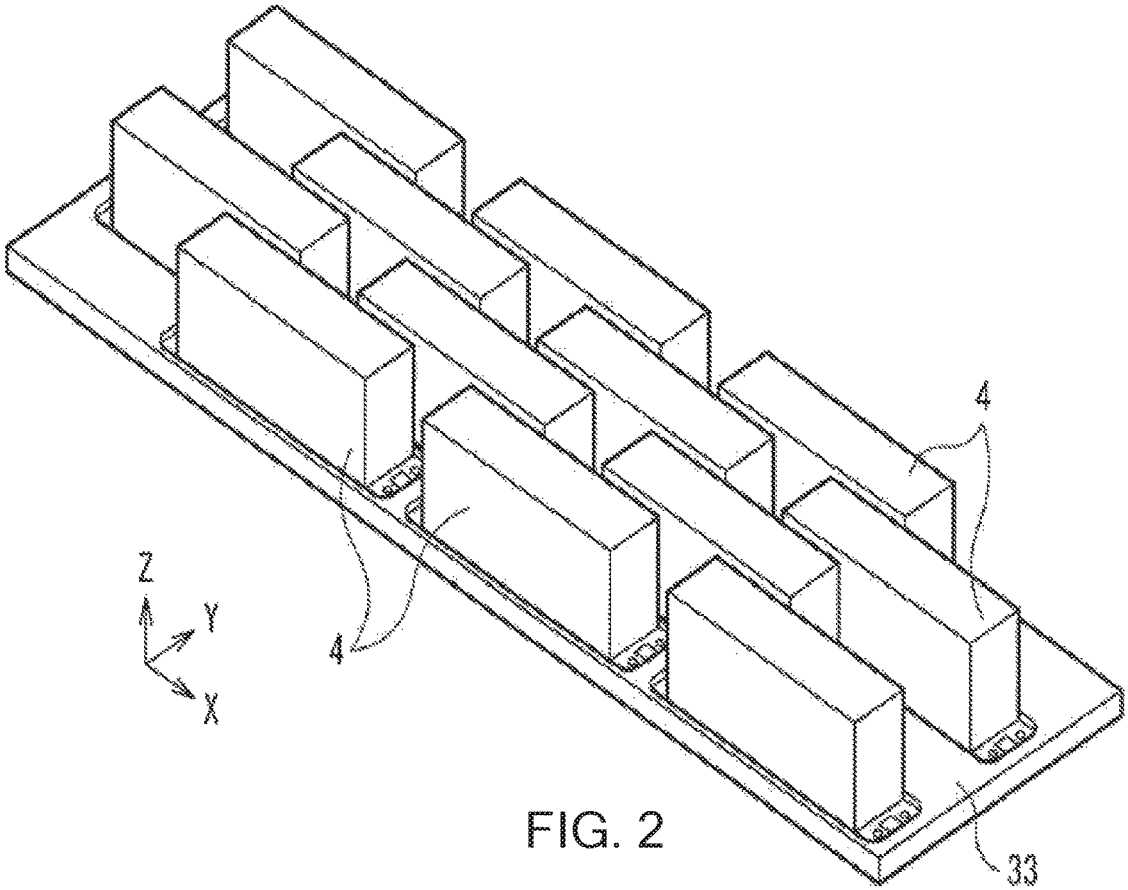
FIG. 2 is a perspective view schematically showing a configuration example of a liquid jet head and a carriage shown in FIG. 1.
Figure 3:
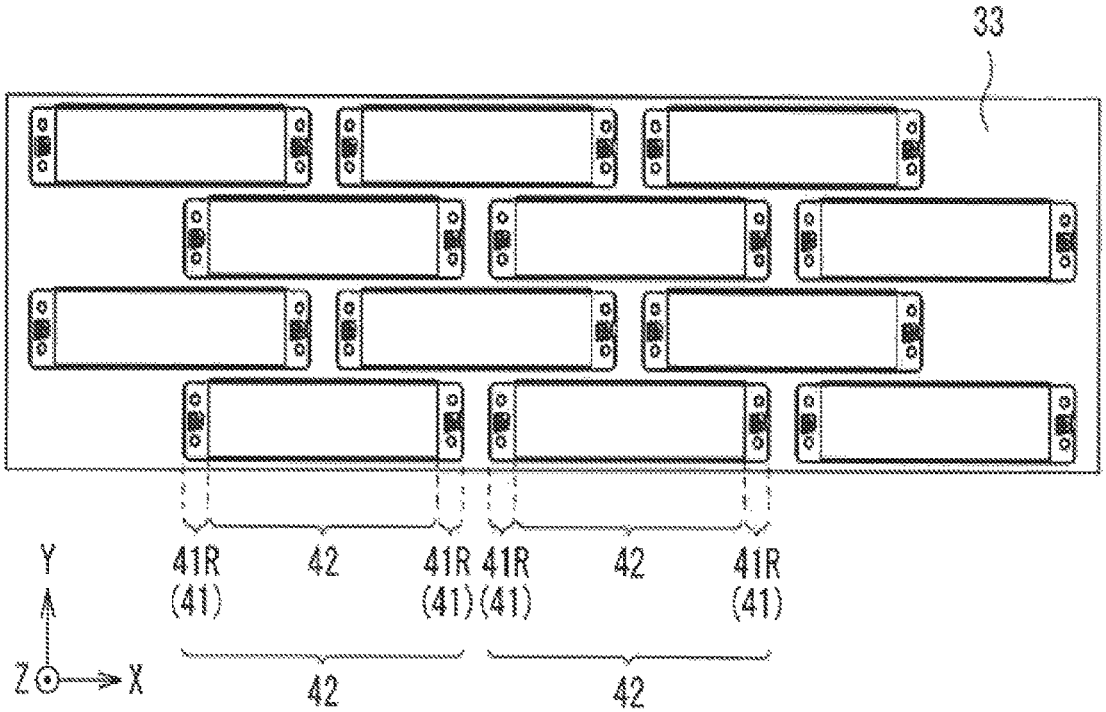
FIG. 3 is a plan view of the liquid jet head and the carriage shown in FIG. 2.

FIG. 2 and FIG. 3 show an example of an arrangement of the plurality of inkjet heads 4 mounted on the carriage 33. FIG. 2 is a perspective view showing a configuration of the plurality of inkjet heads 4 mounted on the carriage 33, and FIG. 3 shows a planar configuration thereof.

On the carriage 33, there are mounted, for example, the twelve inkjet heads 4 as described above. The detailed configuration of the inkjet heads 4 will be described later. Each of the inkjet heads 4 includes a base plate 41, and a cover 42 covering a part of head modules (head modules 40 shown in FIG. 40 described later) mounted on the base plate 41 (FIG. 3). The base plate 41 is a plate-like member having, for example, a roughly rectangular planar shape (along an X-Y plane). The base plate 41 has positioning areas 41R in, for example, both end parts in a long-side direction (the X-axis direction). The cover 42 has, for example, a rectangular solid box-like shape, and the long side of the cover 42 is disposed along the long-side direction (the X-axis direction) of the base plate 41. In other words, the inkjet head 4 has a roughly rectangular planar shape. In parts of the base plate 41 exposed from the cover 42, there are disposed the positioning areas 41R. Here, the base plate 41 corresponds to a specific example of a "support member" in the present disclosure.

In the plan view (the X-Y plane), each of the long sides of the inkjet heads 4 is disposed along, for example, the X-axis direction (the carrying direction d in FIG. 1), and each of the short sides of the inkjet heads 4 is disposed along the Y-axis direction (the width direction of the recording paper P shown in FIG. 1). For example, the three inkjet heads 4 are disposed along the X-axis direction of the carriage 33. The three inkjet heads 4 are disposed so that the positions in the Y-axis direction are in alignment with each other. Further, in the Y-axis direction of the carriage 33, there are disposed the four inkjet heads 4 in a zigzag manner. Specifically, in the inkjet heads 4 adjacent to each other in the Y-axis direction, the positions in the X-axis direction of one end and the other end of a long side are disposed so as to be shifted as much as a half of the size of the long side. In other words, in the printer 1, the plurality of inkjet heads 4 are arranged in the carriage 33 in a zigzag manner. By arranging the plurality of inkjet heads 4 in the zigzag manner as described above, it is possible to fill the gap between the inkjet heads 4 adjacent to each other in the X-axis direction with another inkjet head 4 adjacent in the Y-axis direction.

It should be noted that it is arranged that there is constituted a moving mechanism for moving the inkjet heads 4 and the recording paper P relatively to each other by such a scanning mechanism 6 and the carrying mechanisms 2*a*, 2*b* described above.

[Detailed Configuration of Inkjet Heads 4]

Figure 4:
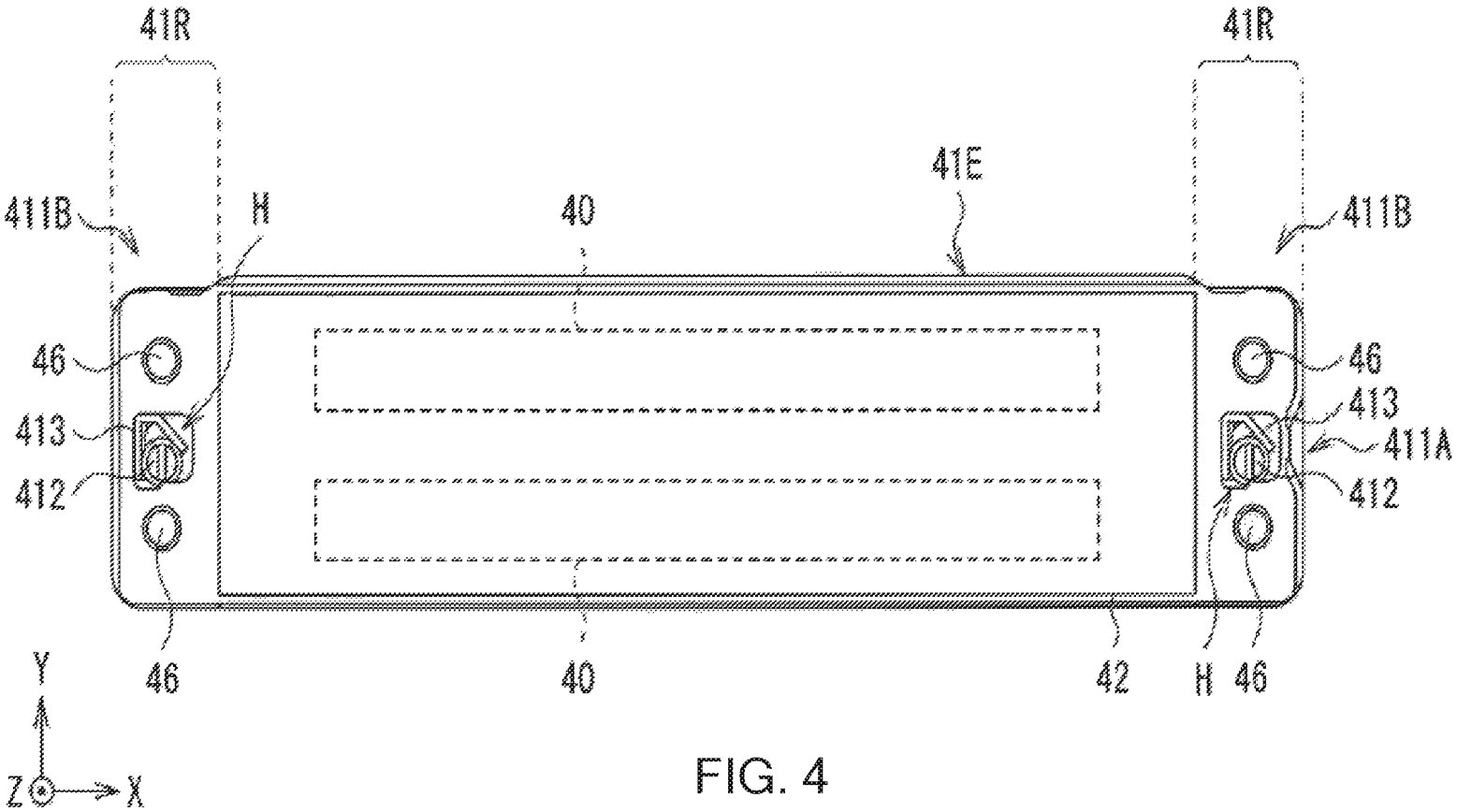
FIG. 4 is a plan view showing an example of a specific configuration of the liquid jet head shown in FIG. 3.
Figure 5:
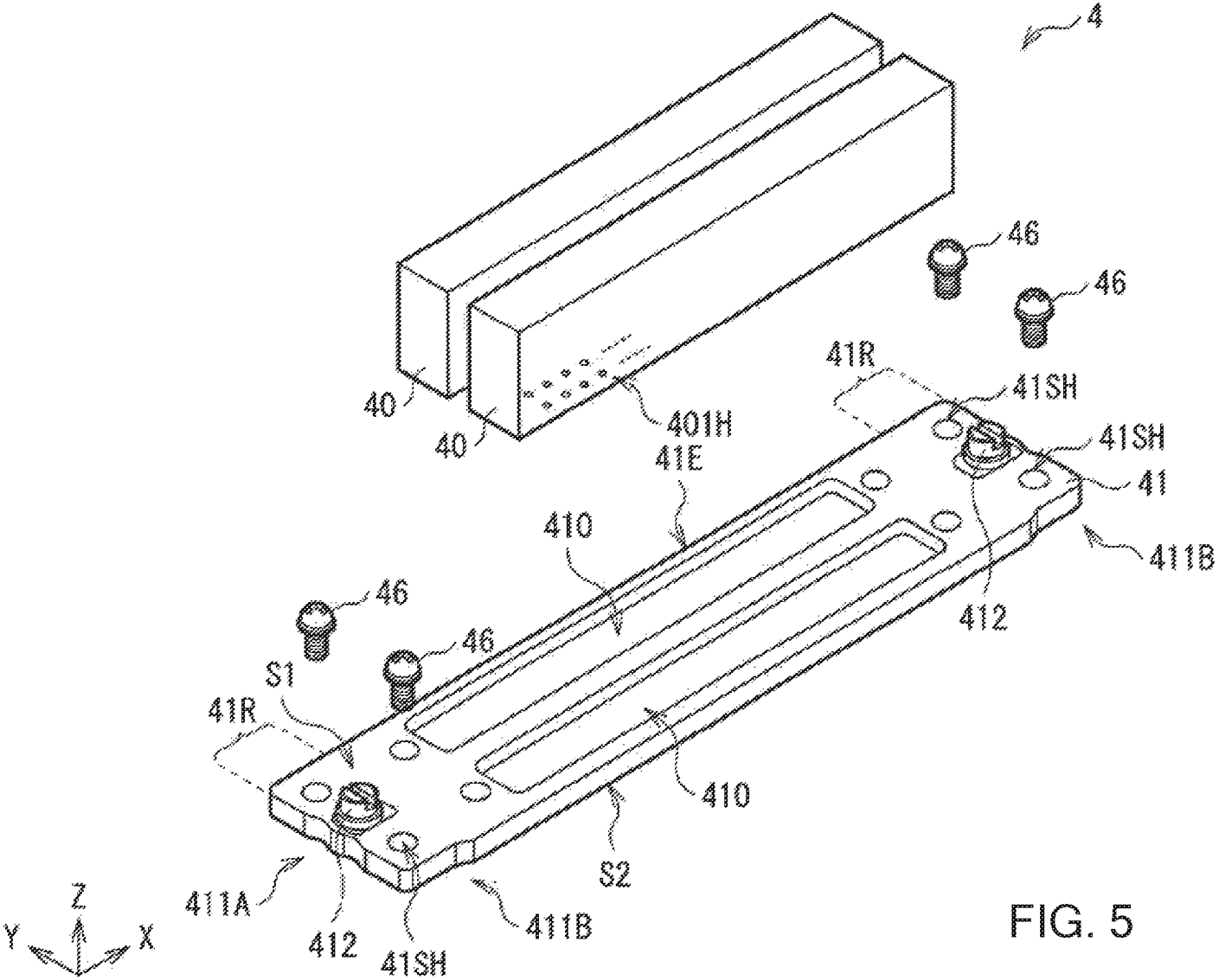
FIG. 5 is an exploded perspective view schematically showing the configuration of the liquid jet head shown in FIG. 4.

Then, the detailed configuration example of the inkjet heads 4 will be described with reference to FIG. 4, FIG. 5 in addition to FIG. 2, FIG. 3. FIG. 4 shows a planar configuration of the inkjet head 4, and FIG. 5 is a schematic exploded perspective view of the inkjet head 4. In FIG. 5, the illustration of the cover 42 is omitted.

The inkjet head 4 mainly has the base plate 41 fixed to the carriage 33, the head modules 40 mounted on the base plate 41, and the cover 42 for protecting a part of the head modules 40. In each of the head modules 40, there is disposed a plurality of nozzle holes 401H. Here, the head module 40 corresponds to a specific example of a "jet section" in the present disclosure.

(Base Plate 41)

The base plate 41 is a support member for supporting the head modules 40. The base plate 41 shaped like a flat plate has an obverse surface S1, and a reverse surface S2 facing to an opposite side to the obverse surface S, wherein the cover 42 is mounted on the obverse surface S1. The base plate 41 is disposed so that the thickness direction (a Z-axis direction) thereof is parallel to a jet direction of the ink (the ink 9 shown in FIG. 6 described later) from the nozzle holes 401H. The obverse surface S1 and the reverse surface S2 each have, for example, a roughly rectangular shape. Such a base plate 41 has an outer circumferential edge 41E having a roughly rectangular shape. The outer circumferential edge 41E is an edge of the base plate 41 in the X-axis direction and the Y-axis direction perpendicular to the thickness direction (the jet direction of the ink) of the base plate 41, and has a roughly rectangular shape. For example, on one of a pair of short sides (the sides extending in the Y-axis direction) constituting the outer circumferential edge 41E of the base plate 41, there is disposed a protruding stopper 411A protruding toward the X-axis direction from the outer circumferential edge 41E around the protruding stopper 411A. The protruding stopper 411A is disposed, for example, in the vicinity of a central part of the short side of the base plate 41. On one of a pair of long sides (the sides extending in the X-axis direction) constituting the outer circumferential edge 41E of the base plate 41, there are disposed protruding stoppers 411B protruding toward the Y-axis direction from the outer circumferential edge 41E around the protruding stoppers 411B. The protruding stoppers 411B are disposed, for example, in the vicinity of both edges of the long side of the base plate 41. The protruding stoppers 411A, 411B are made to have contact with predetermined positions of the carriage 33. Due to the protruding stoppers 411A, 411B, a rough position of the base plate 41 with respect to the carriage 33 is set.

In a central part of the base plate 41, there are disposed insertion holes 410 to which the head modules 40 are respectively inserted. The insertion holes 410 are each an elongated hole having a rectangular planar shape, and each penetrate the base plate 41 in the thickness direction. Long sides of the insertion hole 410 are disposed roughly in parallel to the long side constituting the outer circumferential edge 41E, and short sides of the insertion hole 410 are disposed roughly in parallel to the short side constituting the outer circumferential edge 41E. For example, the base plate 41 is provided with the two insertion holes 410 disposed side by side along the Y-axis direction, and the head modules 40 are inserted respectively in the insertion holes 410.

In the both end parts in the long-side direction (the X-axis direction) of such abase plate 41, there are disposed the positioning areas 41R. The pair of positioning areas 41R are areas for positioning the nozzle holes 401H (nozzle arrays) of the head modules 40 mounted on the base plate 41 with respect to the carriage 33. The pair of positioning areas 41R are disposed outside the head modules 40 and the cover 42 in the plan view. The detailed configuration of the positioning areas 41R will be described later. Such a base plate 41 is formed of a metal material such as a stainless steel (SUS).

(Head Modules 40)

Figure 6:
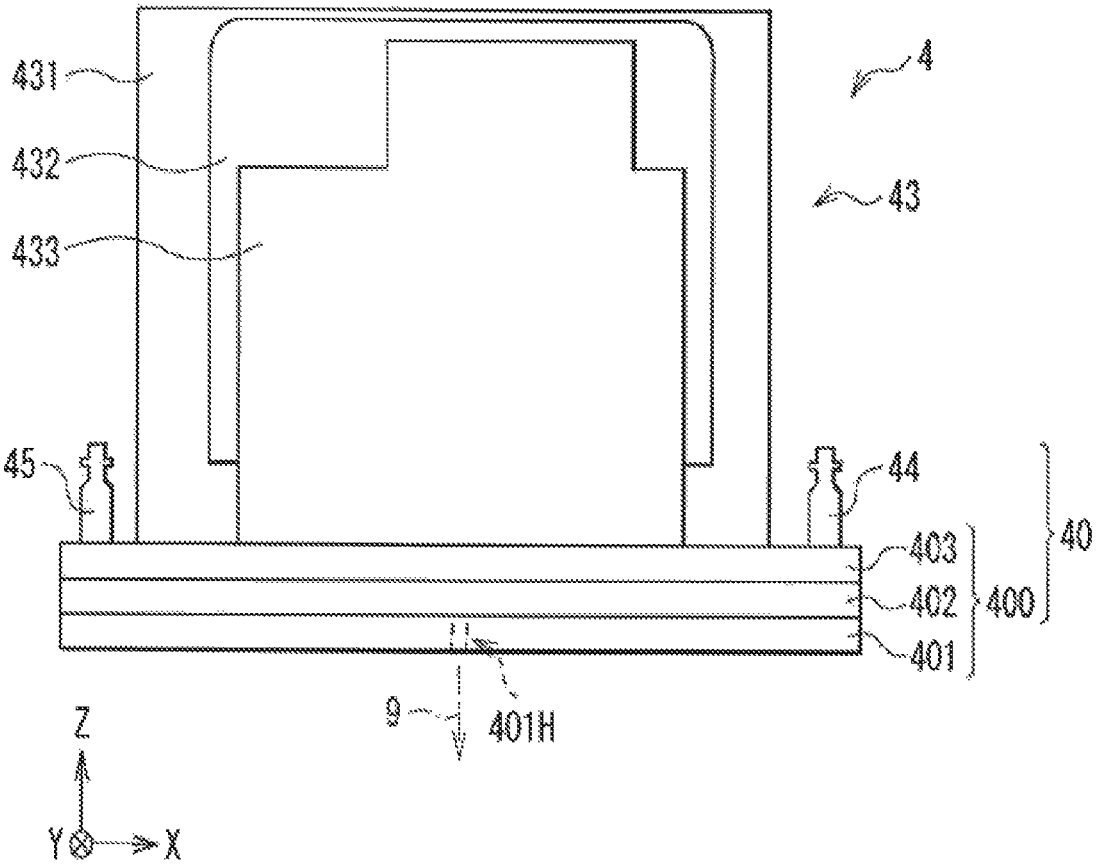
FIG. 6 is a schematic plan view showing the configuration of the liquid jet head shown in FIG. 5.

FIG. 6 schematically shows a planar configuration (along an X-Z plane) of the inkjet head 4. The inkjet head 4 has, for example, an electronic control board 43 in addition to the head modules 40 described above. The head modules 40 each include, for example, a head chip 400, an introduction port 44, and a discharge port 45.

In the head module 40, there is formed a flow channel of the ink 9 extending from the introduction port 44 toward the discharge port 45, and at the same time, there are disposed the nozzle holes 401H (discharge openings) in the flow channel.

The head chip 400 discharges the ink 9 from the nozzle holes 401H to thereby jet the ink 9 to the recording medium. The head chip 400 includes, for example, a nozzle plate 401, an actuator plate 402, and a cover plate 403 stacked in sequence from a side far from the electronic control board 43.

The nozzle plate 401 has the nozzle holes 401H as jet openings for the ink 9. Here, the nozzle plate 401 has, for example, the plurality of nozzle holes 401H, and the plurality of nozzle holes 401H is arranged along, for example, the X-axis direction. In other words, the nozzle plate 401 has a nozzle array extending in the X-axis direction (FIG. 5). It should be noted that in FIG. 6, one nozzle hole 401H is described alone in order to simplify the content of the illustration. In the head module 40, it is arranged that the ink 9 is jetted in the Z-axis direction from the reverse surface S2 side of the base plate 41 via the nozzle holes 401H.

The actuator plate 402 has, for example, a plurality of channels (a plurality of jet channels to which the ink 9 is introduced, and a plurality of dummy channels to which the ink 9 is not introduced) not shown. This actuator plate 402 electrically change the internal pressure of the jet channel to which the ink 9 is introduced when, for example, performing recording to thereby jet the ink 9 to the outside from the jet channel via the nozzle holes 401H. The cover plate 403 has, for example, a plurality of slits not shown, and introduces the ink 9 to the actuator plate 402 (the plurality of jet channels) via the plurality of slits.

(Electronic Control Board 43)

The electronic control board 43 controls the overall operation of the inkjet head 4. The electronic control board 43 includes, for example, a circuit board 431, a drive circuit 432, and a flexible board 433. The circuit board 431 is disposed, for example, upright on the head chip 400. The drive circuit 432 is provided to, for example, the circuit board 431, and includes electronic components such as an integrated circuit (IC). The flexible board 433 is coupled to, for example, each of the head chip 400 and the drive circuit 432.

The introduction port 44 is a tubular component provided with an introduction opening for the ink 9, and is coupled to one end part of the head chip 400 (the cover plate 403). The discharge port 45 is a tubular component provided with a discharge opening for the ink 9, and is coupled to the other end part of the head chip 400 (the cover plate 403). It should be noted that each of the introduction port 44 and the discharge port 45 can be coupled to a supply tube, and the like not shown in order to, for example, circulate the ink 9.

(Cover 42)

The cover 42 is disposed on the base plate 41 so as to cover the periphery of the electronic control board 43. The electronic control board 43 is encapsulated inside the cover 42 shaped like a box. The cover 42 is a member for preventing the ink 9 from adhering to the electronic control board 43. The cover 42 is formed of a material having resistance to the material of the ink 9. The cover 42 is formed of a resin material such as poly phenylene sulfide (PPS) or nylon, or a metal material.

(Positioning Areas 41R)

Figure 7:
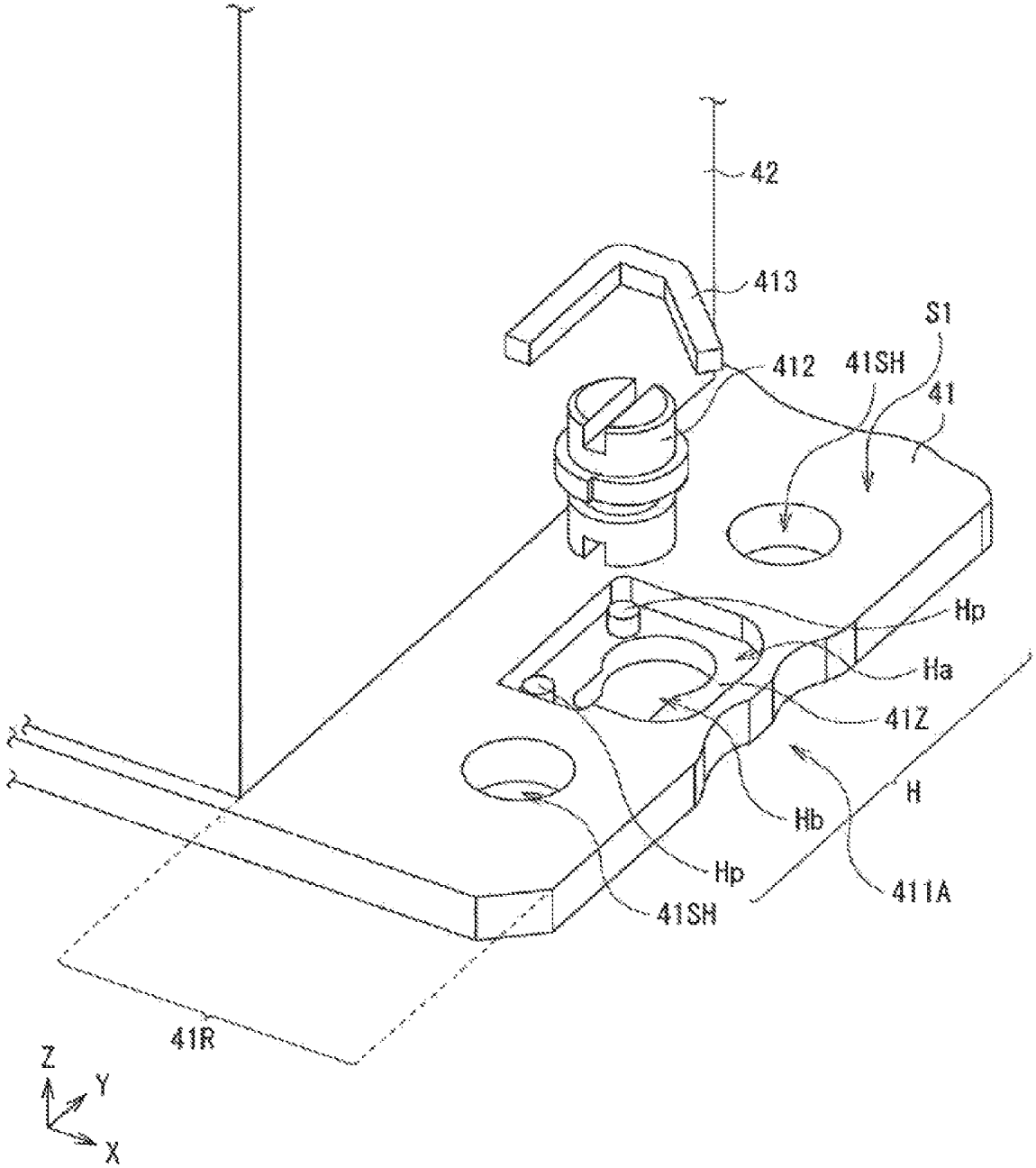
FIG. 7 is an exploded perspective view showing the vicinity of a positioning area shown in FIG. 5 in an enlarged manner.

FIG. 7 is an exploded perspective view showing the configuration of the vicinity of the positioning area 41R. Each of the pair of positioning areas 41R is provided with a hole part H and screw holes 41SH. Inside the hole part H, there are disposed a position adjustment member 412 and a biasing member 413. Here, the position adjustment member 412 corresponds to a specific example of a "biased member" in the present disclosure.

Figure 8A:
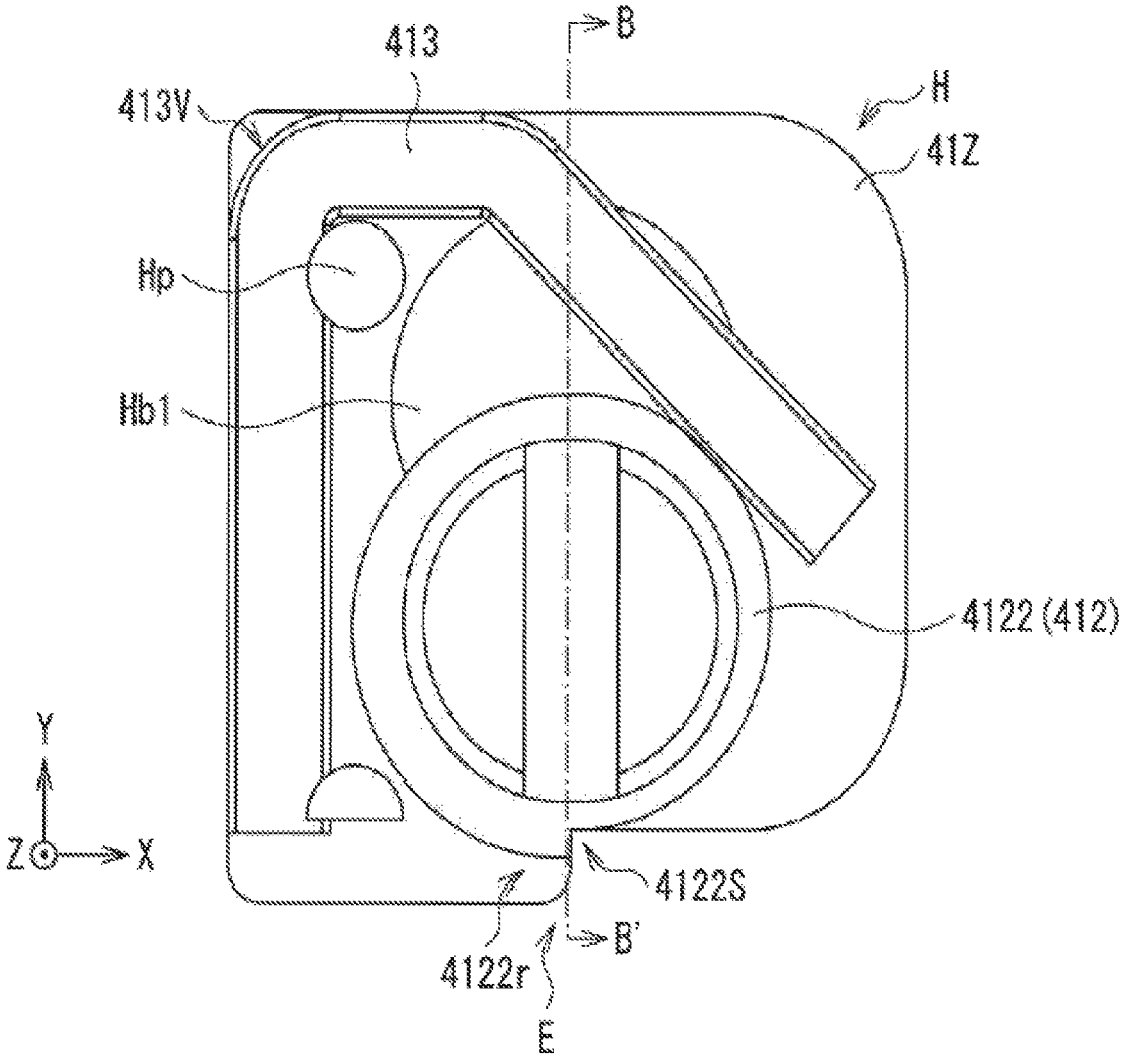
FIG. 8A is a schematic plan view showing a configuration of a hole part and the inside of the hole part shown in FIG. 5.
Figure 8B:
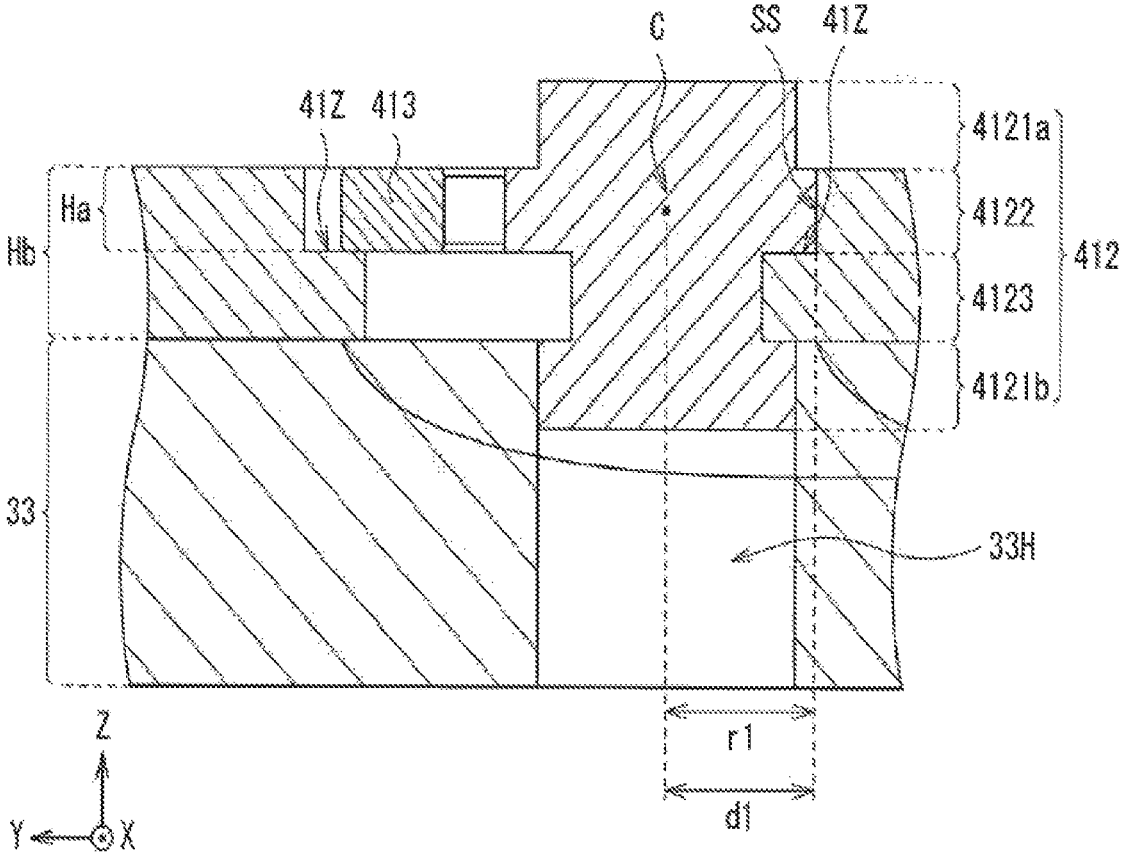
FIG. 8B is a schematic diagram showing a cross-sectional configuration along the line B-B' shown in FIG. 8A.

FIG. 8A is a plan view showing the position adjustment member 412 and the biasing member 413 disposed inside the hole part H, and FIG. 8B shows a cross-sectional configuration along the line B-B' shown in FIG. 8A.

The hole part H has a bottomed hole Ha disposed on the obverse surface S1 side in the thickness direction of the base plate 41, and a through hole Hb penetrating in the thickness direction of the base plate 41. A seating surface 41Z of the bottomed hole Ha is disposed between the obverse surface S1 and the reverse surface S2 of the base plate 41, namely in the middle in the thickness direction of the base plate 41. On the seating surface 41Z, there are disposed protruding parts Hp protruding toward the obverse surface S1. The through hole Hb is communicated with the bottomed hole Ha, and penetrates the base plate 41 from the obverse surface S1 to the reverse surface S2 via the seating surface 41Z.

The screw holes 41SH each penetrate the base plate 41 in the thickness direction, and screws 46 (see FIG. 5) are respectively inserted in the screw holes 41SH. The screws 46 are also inserted in screw holes provided to the carriage 33 in addition to the screw holes 41SH. In other words, the position of the base plate 41 with respect to the carriage 33 is fixed by the screws 46. For example, in each of the pair of positioning areas 41R, there are disposed the two screw holes 41SH and the single hole part H.

Figure 9:
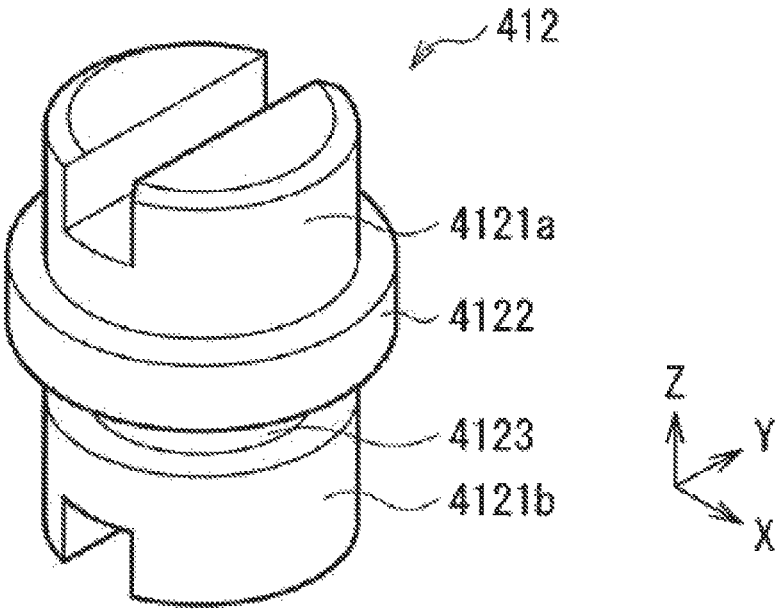
FIG. 9 is a perspective view schematically showing an example of a configuration of a position adjustment member shown in FIG. 7.

Then, the position adjustment member 412 inserted in the hole part H will be described using FIG. 9 together with FIG. 7 through FIG. 8B. FIG. 9 is a perspective view showing the configuration of the position adjustment member 412. The position adjustment member 412 is for adjusting the position in the X-Y plane of the base plate 41 with respect to the carriage 33 with high accuracy. In other words, due to the position adjustment member 412, it is possible to adjust the positions in the X-Y plane of the nozzle holes 401H (the nozzle array) with respect to the carriage 33. For example, it is arranged that position in the Y-axis direction of the nozzle array and the arranging direction of the nozzle array are adjusted using the position adjustment member 412. In the present embodiment, the position adjustment member 412 is disposed inside the outer circumferential edge 41E of the base plate 41, specifically inside the hole part H, together with the biasing member 413. Although the details will be described later, thus, it becomes possible to reduce the area necessary to install the inkjet head 4.

The position adjustment member 412 includes a shaft part 4121*a*, an eccentric part 4122, an intermediate part 4123, and a shaft part 4121*b* in this order along, for example, the thickness direction of the base plate 41 (FIG. 9). In other words, the position adjustment member 412 is formed of, for example, an eccentric cam including the eccentric part 4122. The position adjustment member 412 formed of the eccentric cam easy to provide a compact configuration along the thickness direction of the base plate 41, and the eccentric part 4122 and the intermediate part 4123 are easily housed within the thickness range of the base plate 41. Therefore, as described later, it becomes easy to install the position adjustment member 412 from the back of the carriage 33. Due to such a position adjustment member 412, it is possible to easily achieve the accurate position adjustment. Here, the shaft part 4121*b* corresponds to a specific example of a "first shaft part" in the present disclosure, and the shaft part 4121*a* corresponds to a specific example of a "second shaft part" in the present disclosure.

For example, the shaft part 4121*b* is inserted in a shaft hole 33H of the carriage 33 (FIG. 8B). The cross-sectional (X-Y cross-sectional) shape of the shaft part 4121*b* is, for example, a circle. The planar shape of the shaft hole 33H is, for example, a circle. In this case, the diameter of the shaft part 4121*b* is substantially the same as the diameter of the shaft hole 33H. Thus, the position adjustment member 412 is pivotally supported by the shaft hole 33H of the carriage 33 in a rotatable manner. By the position adjustment member 412 being pivotally supported by the shaft hole 33H of the carriage 33, the position of the position adjustment member 412 with respect to the carriage 33 is fixed. In other words, the position of the position adjustment member 412 with respect to the carriage 33 can solely be set by the shaft hole 33H of the carriage 33. In other words, it is not necessary to use a plurality of members for setting the position of the position adjustment member 412 with respect to the carriage 33. Therefore, it is possible to adjust the positions of the nozzle holes 401H with respect to the carriage 33 with simple constituents.

The intermediate part 4123 located between the shaft part 4121*b* and the eccentric part 4122 is disposed in a part of the through hole Hb located on the reverse surface S2 side of the seating surface 41Z. The planar shape of the intermediate part 4123 is, of example, a circle, and is made smaller in diameter than the shaft parts 4121*a*, 4121*b*. The eccentric part 4122 is made to have contact with a reference surface SS (described later) disposed inside the hole part H. It is arranged that by rotating the position adjustment member 412, the contact state of the eccentric part 4122 with the reference surface SS changes to displace the base plate 41 in the X-Y plane.

Figure 10:
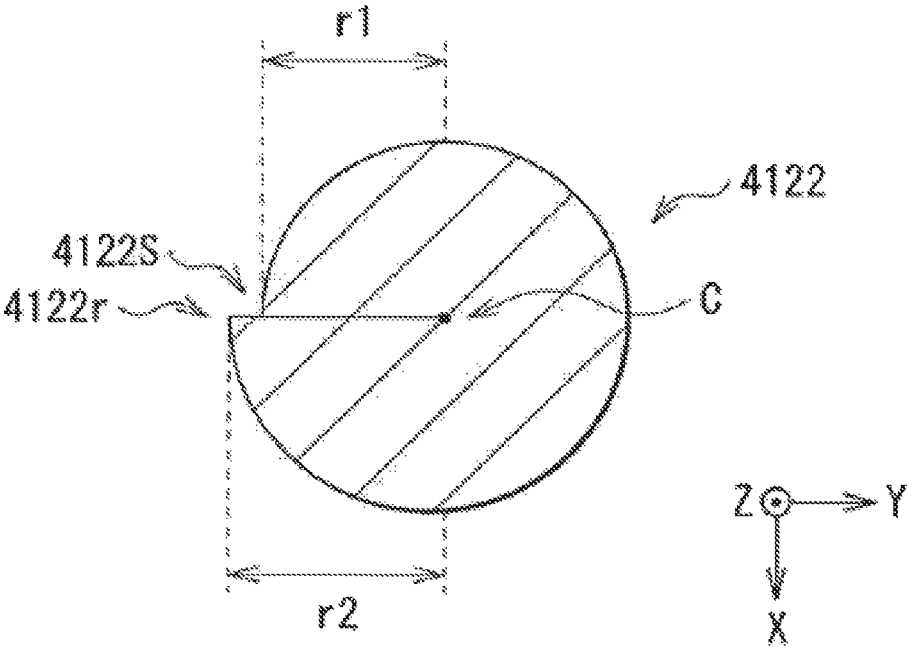
FIG. 10 is a schematic diagram showing a cross-sectional configuration of an eccentric part shown in FIG. 9.

FIG. 10 shows a cross-sectional (X-Y cross-sectional) configuration of the eccentric part 4122. The cross-sectional shape of the eccentric part 4122 is, for example, a distorted circular shape, and has a part different in distance from the rotational center C of the position adjustment member 412 to the circumference. The eccentric part 4122 includes, for example, an initial part 4122*s* having the shortest distance r1 from the rotational center C to the circumference, and a rotation restriction part 4122*r* having a distance r2 from the rotational center C to the circumference longer than the distance r1. The initial part 4122*s* is a part which has contact with the reference surface SS in a state in which the position adjustment member 412 has been inserted in the hole part H, and has not yet been rotated, namely in an initial state. The rotation restriction part 4122*r* is, for example, disposed adjacent to the initial part 4122*s*, and a step is formed in the plan view between the initial part 4122*s* and the rotation restriction part 4122*r*. The distance r2 has, for example, the maximum value of the distance from the rotational center C to the circumference provided to the eccentric part 4122.

The shaft part 4121*a* disposed on the opposite side to the shaft part 4121*b* across the eccentric part 4122 is disposed so as to protrude in the Z-axis direction from, for example, the obverse surface S1 of the base plate 41. The planar shape of the shaft part 4121*a* is, for example, a circle similarly to the planar shape of the shaft part 4121*b*, and the diameter of the shaft part 4121*a* is made roughly the same as the diameter of the shaft part 4121*b*. The shaft part 4121*a* is configured to be able to be pivotally supported by the shaft hole 33H of the carriage 33. By the position adjustment member 412 having such a shaft part 4121*a*, it becomes also possible to insert the shaft part 4121*a* in the shaft hole 33H of the carriage 33. Therefore, it becomes possible to install the inkjet head 4 from either of the sides of the carriage 33.

The biasing member 413 is disposed in the bottomed hole Ha of the hole part H (FIG. 8A, FIG. 8B). The biasing member 413 is mainly for biasing the base plate 41 toward the carriage 33. More specifically, it is arranged that by the biasing member 413 biasing the position adjustment member 412, the base plate 41 is biased toward the carriage 33. By disposing such a biasing member 413, the rough position in the X-Y plane of the base plate 41 with respect to the carriage 33, namely the rough position in the X-Y plane of each of the nozzle holes 401H with respect to the carriage 33, is set. Further, since the biasing member 413 is disposed, even when rotating the position adjustment member 412 at that position, it is possible to displace the base plate 41 without backlash. Here, the biasing member 413 is disposed inside the hole part H together with the position adjustment member 412. Therefore, it becomes unnecessary to provide a space for disposing the biasing member 413 outside the outer circumferential edge 41E of the base plate 41.

The biasing member 413 is formed of, for example, a wire spring, and has a bend part 413V around the center in the extending direction. The bend part 413V is disposed between the protruding part Hp and the inner wall of the bottomed hole Ha, and thus, the biasing member 413 is fixed to the bottomed hole Ha. In the biasing member 413, a part extending toward one side from the bend part 413V is made to have contact with the inner wall of the bottomed hole Ha, and a part extending toward the other side from the bend part 413V is made to have contact with the eccentric part 4122 of the position adjustment member 412. Thus, the biasing member 413 biases the position adjustment member 412 pivotally supported by the carriage 33, and due to the reaction to the biasing force, the base plate 41 is biased toward the carriage 33 via the inner wall of the hole part H. By disposing the biasing member 413 inside the hole part H as described above, due to the interaction of the forces inside the hole part H, the position of the position adjustment member 412 with respect to the base plate 41 is kept, and at the same time, the position of the base plate 41 with respect to the carriage 33 is kept.

It is possible for the biasing member 413 formed of the wire spring to easily form the bend part 413V, and thus, to easily be disposed inside the hole part H. Therefore, as described above, it is possible to easily realize the interaction of the forces between the position adjustment member 412 and the base plate 41 inside the hole part H.

Figure 11:
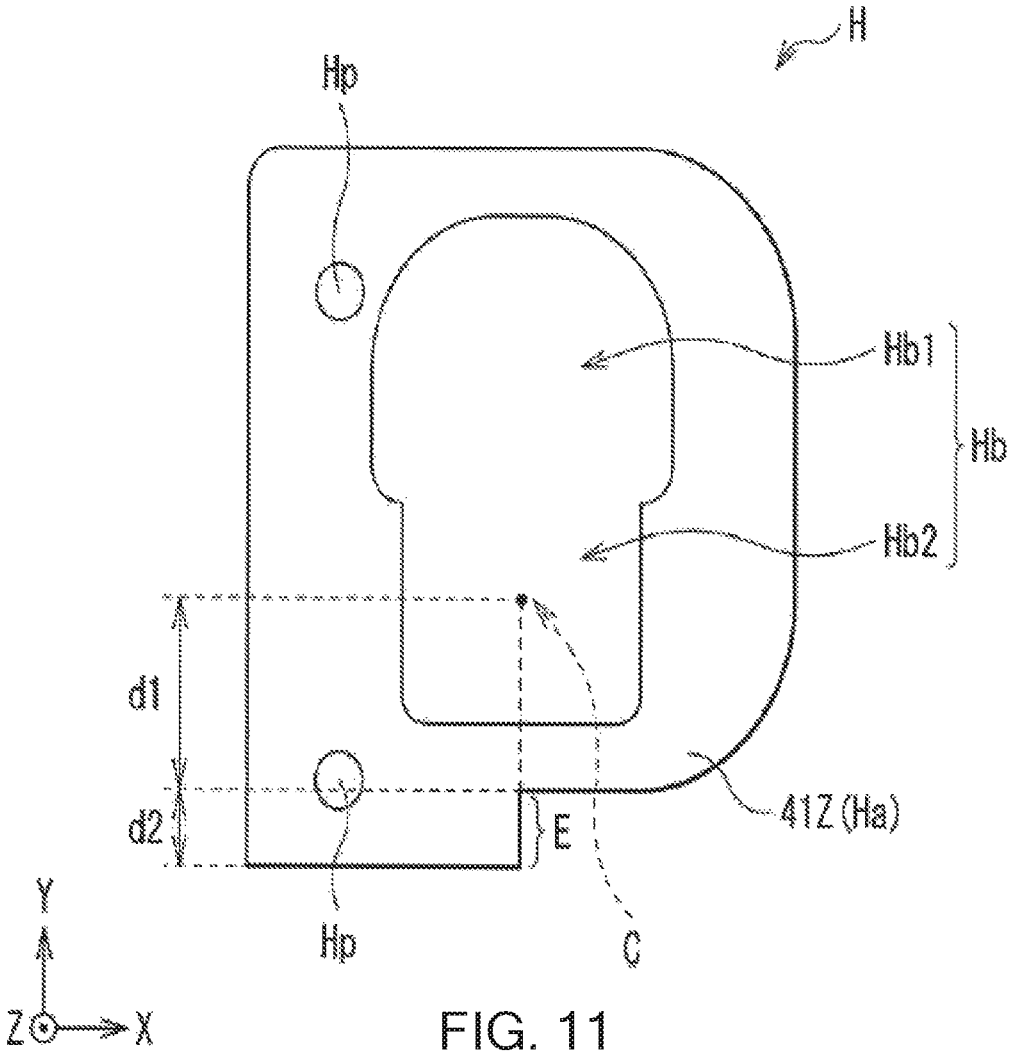
FIG. 11 is a schematic plan view showing an example of the configuration of the hole part shown in FIG. 7.

Then, the hole part H will be described using FIG. 11 together with FIG. 7 through FIG. 8B. FIG. 11 shows a planar shape of the hole part H. The hole part H includes, for example, the bottomed hole Ha having a roughly quadrangular planar shape, and the through hole Hb having a keyhole-like planar shape. The bottomed hole Ha is made larger than the through hole Hb, and the outer circumferential edge of the bottomed hole Ha is disposed outside the outer circumferential edge of the through hole Hb in the plan view. The reference surface SS with which the eccentric part 4122 is made to have contact is disposed in a part of the inner wall of the bottomed hole Ha forming the outer circumferential edge of the bottomed hole Ha (FIG. 8B).

The reference surface SS has, for example, a distance d1 from a position corresponding to the rotational center C of the position adjustment member 412 (FIG. 8B, FIG. 11). The distance d1 is roughly the same as, for example, the distance r1 from the rotational center C of the initial part 4122*s* of the eccentric part 4122. By rotating the position adjustment member 412, the distance from the rotational center C of the eccentric part 4122 made to have contact with the reference surface SS gradually changes. It is arranged that the nozzle holes 401H (the head modules 40) with respect to the carriage 33 are displaced in the X-Y plane together with the base plate 41, accordingly.

The bottomed hole Ha is provided with an engaging part E disposed at a position adjacent to the reference surface SS (FIG. 8A, FIG. 11). The engaging part E is a step portion disposed in one side of the outer circumferential edge of the bottomed hole Ha having the roughly quadrangular shape, and is disposed at a position adjacent to the reference surface SS in the rotational direction of the position adjustment member 412. For example, the engaging part E is a part projecting outward from the position of the reference surface SS as much as a distance d2. The sum of the distance d2 and the distance d1 is made longer than the distance r2 from the rotational center C of the rotation restriction part 4122*r* of the eccentric part 4122. When the initial part 4122*s* of the eccentric part 4122 is made to have contact with the reference surface SS, the rotation restriction part 4122*r* of the eccentric part 4122 is engaged with such an engaging part E.

The through hole Hb shaped like a keyhole includes a first through hole portion Hb1 having a roughly circular planar shape, and a second through hole portion Hb2 having a roughly quadrangular planar shape. The first through hole portion Hb1 and the second through hole portion Hb2 are communicated with each other, and are arranged side by side in a predetermined direction (e.g., a direction roughly along the Y axis in FIG. 11). The outer circumferential edge of the first through hole portion Hb1 expands outward (toward the outer circumferential edge of the bottomed hole Ha) from the outer circumferential edge of the second through hole portion Hb2. The intermediate part 4123 of the position adjustment member 412 is disposed in the second through hole portion Hb2 (FIG. 8A). The intermediate part 4123 is inserted in the first through hole portion Hb1 before installing the base plate 41 to the carriage 33, and is then slid in the through hole Hb to be disposed in the second through hole portion Hb2.

[Method of Installing Inkjet Heads 4]

Figure 12:
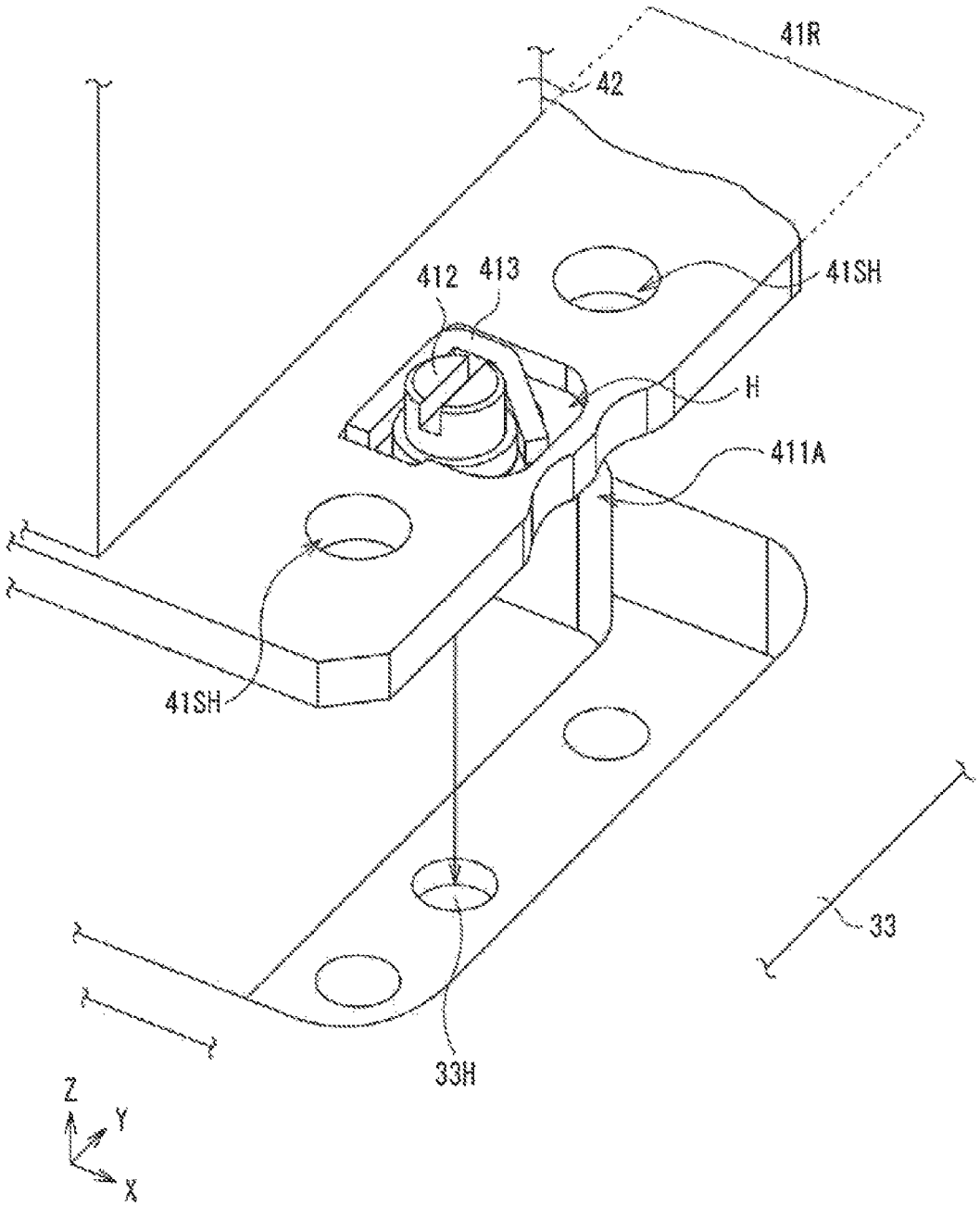
FIG. 12 is a perspective view showing a process of a method of attaching the liquid jet head shown in FIG. 2 and so on to the carriage.
Figure 13:
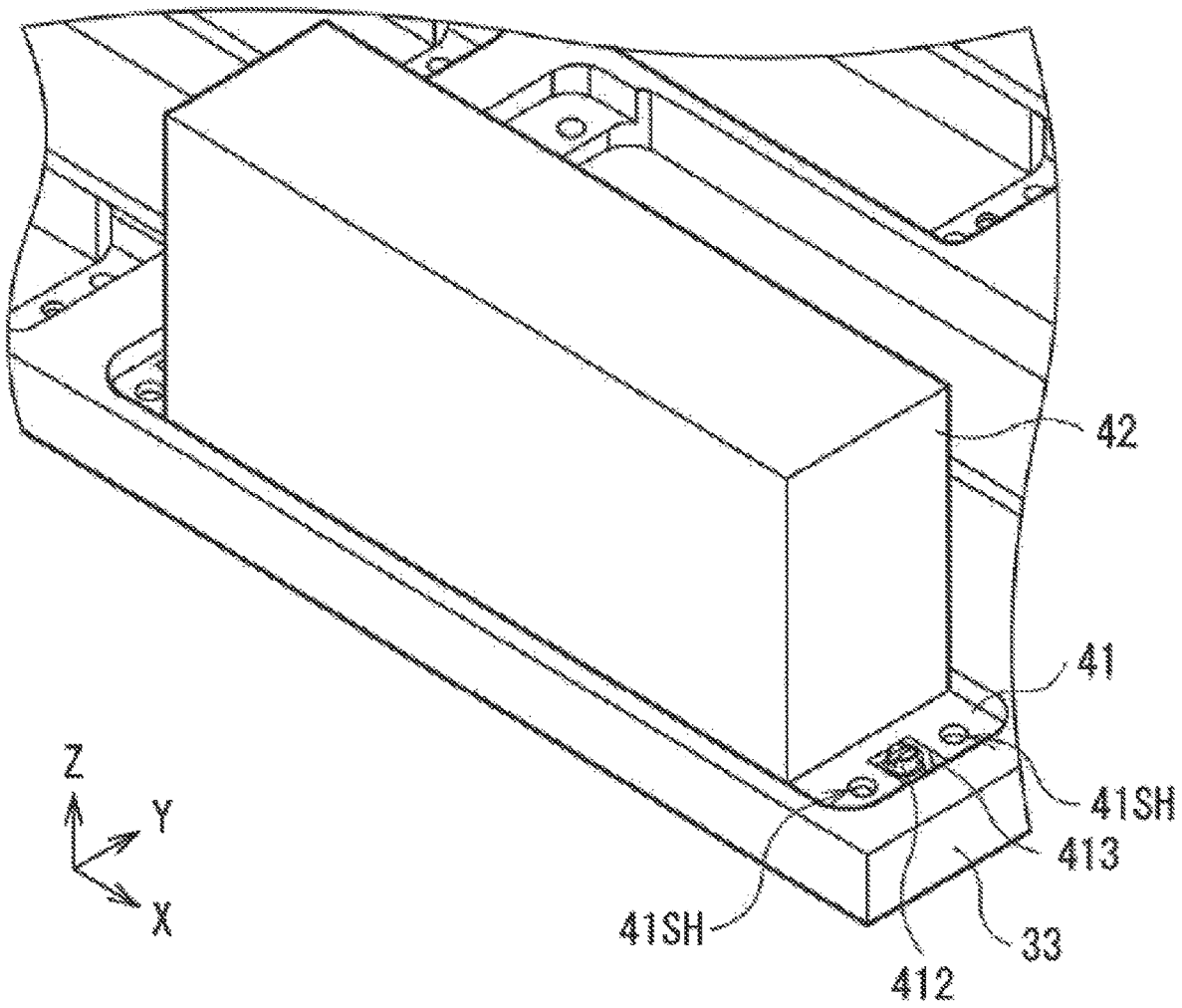
FIG. 13 is a perspective view showing a process following the process shown in FIG. 12.
Figure 14A:
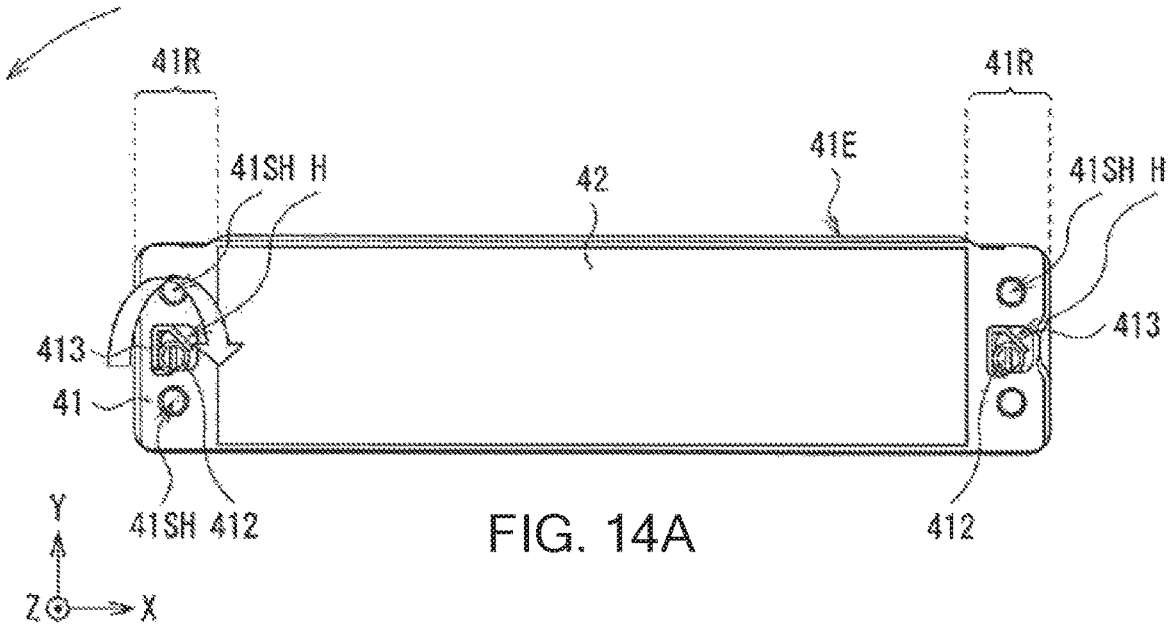
FIG. 14A is a plan view (1) showing a process following the process shown in FIG. 13.
Figure 14B:
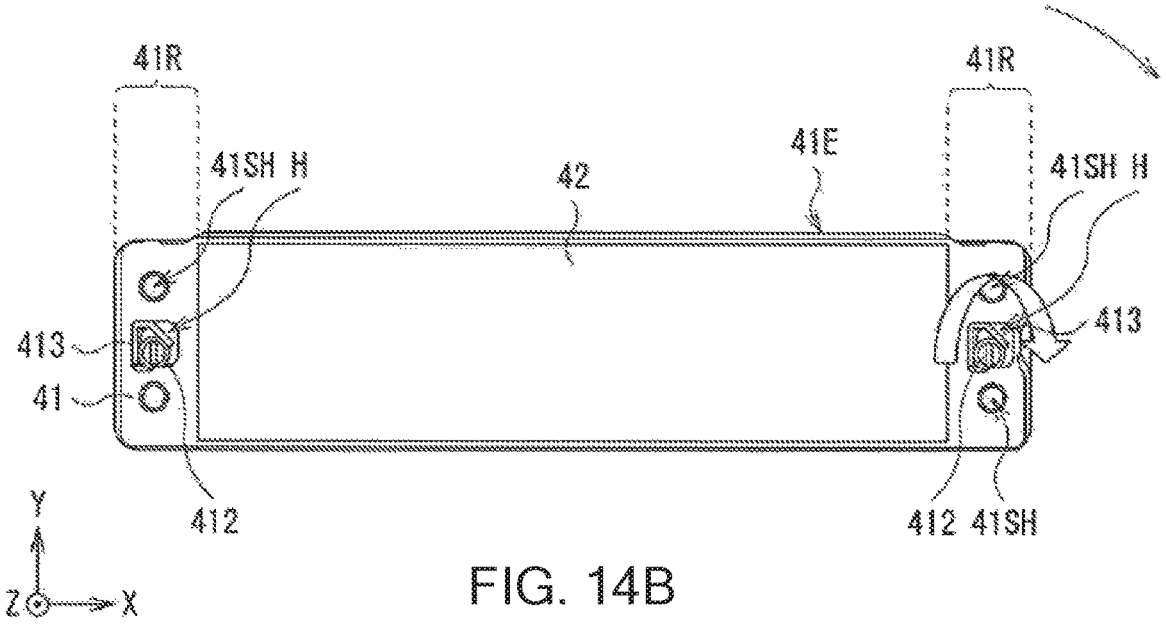
FIG. 14B is a plan view (2) showing a process following the process shown in FIG. 13.
Figure 15:
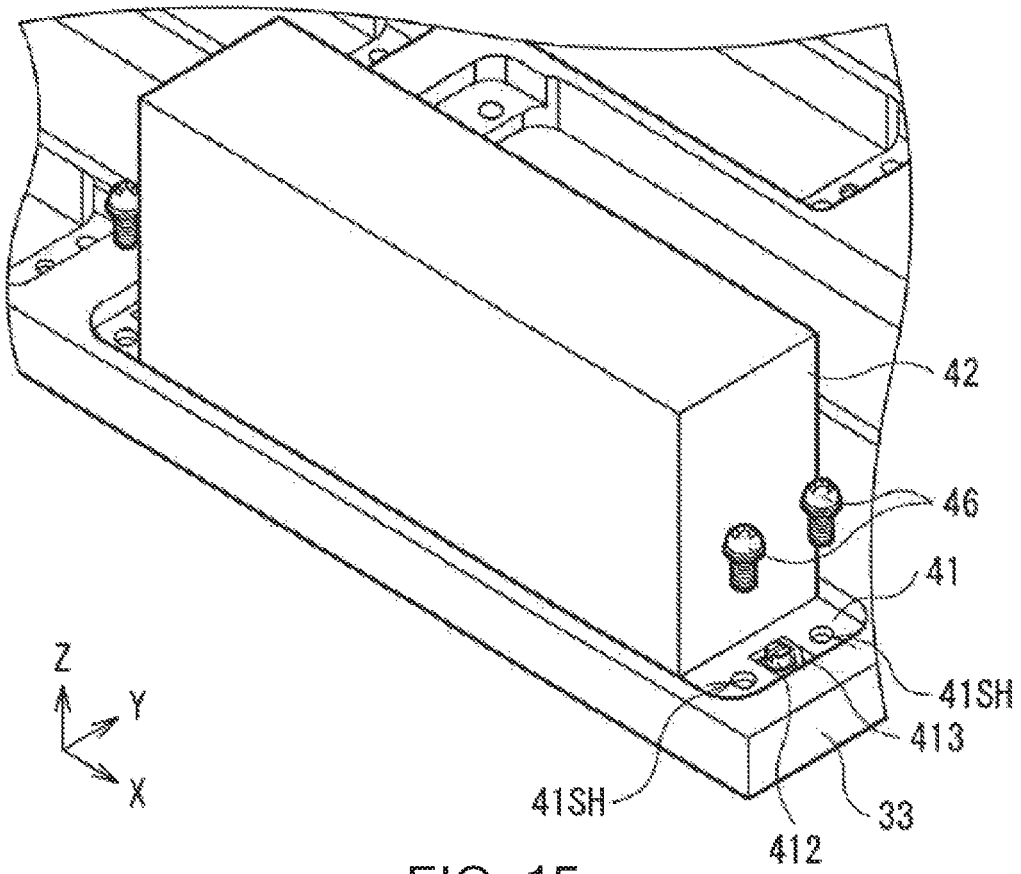
FIG. 15 is a perspective view showing a process following the process shown in FIG. 14A, FIG. 14B.

Then, a method of installing the inkjet heads 4 will be described using FIG. 12 through FIG. 15. FIG. 12, FIG. 13, and FIG. 15 are perspective views showing the respective steps, and FIG. 14A and FIG. 14B are plan views showing a step of positioning the inkjet head 4.

Firstly, the position adjustment member 412 and the biasing member 413 are installed in this order inside the hole part H of the base plate 41. On this occasion, the biasing member 413 is mounted on the seating surface 41Z of the bottomed hole Ha, and then the bend part 413V is fitted between the protruding part Hp and the inner wall of the bottomed hole Ha (see FIG. 7). Further, the shaft part 4121*b* and the intermediate part 4123 are inserted into the first through hole portion Hb1 of the through hole Hb, and then the position adjustment member 412 is slid in the through hole Hb to be moved to the second through hole portion Hb2 (see FIG. 8A, FIG. 8B). Thus, the shaft part 4121*b* projects in the Z-axis direction from the reverse surface S2 of the base plate 41, and at the same time, the intermediate part 4123 is disposed on the reverse surface S2 side of the seating surface 41Z of the second through hole portion Hb2.

After installing the position adjustment member 412 and the biasing member 413 inside the hole part H of the base plate 41, the shaft part 4121*b* of the position adjustment member 412 projecting from the reverse surface S2 of the base plate 41 is inserted into the shaft hole 33H of the carriage 33 as shown in FIG. 12. Thus, the position adjustment member 412 is pivotally supported by the shaft hole 33H of the carriage 33.

When inserting the shaft part 4121*b* of the position adjustment member 412 into the shaft hole 33H of the carriage 33 to mount the base plate 41 on the carriage 33, the biasing member 413 made to have contact with the position adjustment member 412 (specifically the eccentric part 4122) biases the position adjustment member 412 pivotally supported by the shaft hole 33H of the carriage 33. Due to the reaction of the biasing force, the inner wall of the bottomed hole Ha is biased by the biasing member 413. Thus, the protruding stoppers 411A, 411B of the base plate 41 are made to have contact with the predetermined portions of the carriage 33, and the rough position in the X-Y plane of the base plate 41, namely the rough position in the X-Y plane of each of the nozzle holes 401H, with respect to the carriage 33 is set (FIG. 13). On this occasion, the initial part 4122*s* of the eccentric part 4122 (the position adjustment member 412) is disposed at a position opposed to the reference surface SS disposed in the inner wall of the bottomed hole Ha. The initial part 4122*s* is made to have contact with, for example, the reference surface SS (see FIG. 8A, FIG. 8B). It is possible to dispose a gap between the initial part 4122*s* and the reference surface SS. When the base plate 41 is located at the position described above with respect to the carriage 33, the rotation restriction part 4122*r* of the eccentric part 4122 is disposed in the vicinity of the engaging part E of the hole part H (the bottomed hole Ha).

Subsequently, as shown in FIG. 14A, FIG. 14B, by rotating the position adjustment member 412 (the eccentric part 4122), the positions in the X-axis direction and the Y-axis direction of the nozzle holes 401H are adjusted with high accuracy. For example, when rotating the position adjustment member 412 clockwise on the sheet of the drawing, the initial part 4122*s* made to have contact with the reference surface SS moves, a part of the eccentric part 4122 longer in distance from the rotational center C is made to have contact with the reference surface SS. By making the eccentric part 4122 longer in distance from the rotational center C have contact with the reference surface SS, the position in the X-Y plane of the base plate 41, and by extension, the position in the X-Y plane of each of the nozzle holes 401H (the nozzle array) is displaced. For example, when rotating the position adjustment member 412 disposed one of the positioning areas 41R, the base plate 41 is displaced counterclockwise around the other positioning area 41R as a pivot (FIG. 14A). Further, when rotating the position adjustment member 412 disposed the other of the positioning areas 41R, the base plate 41 is displaced clockwise around the one positioning area 41R as a pivot (FIG. 14B). It is also possible to translate the base plate 41 in the Y-axis direction by rotating the position adjustment members 412 in both of the positioning areas 41R.

Figure 16:
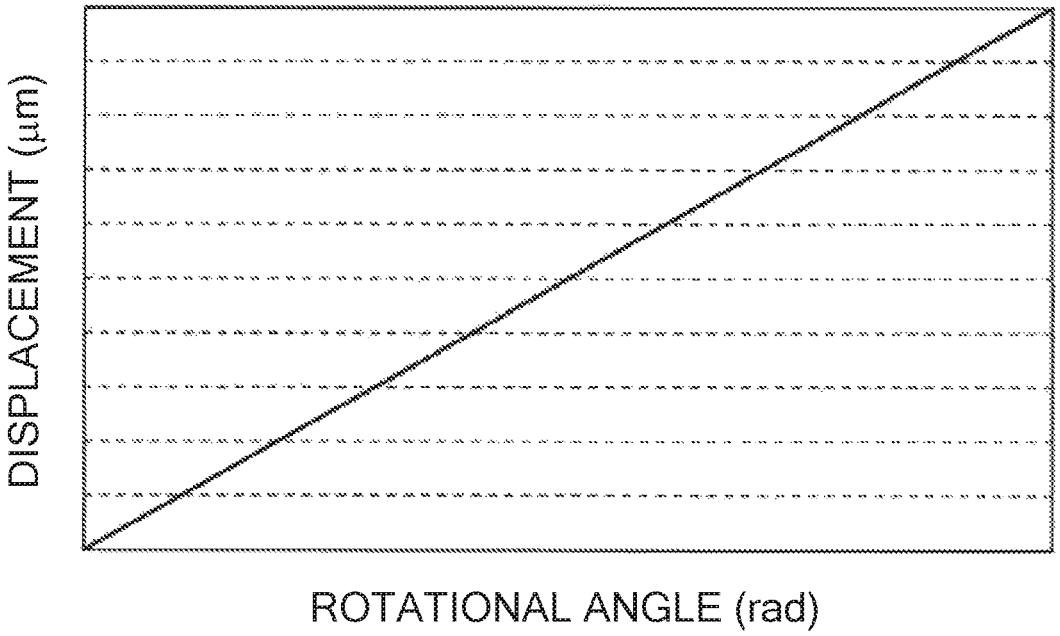
FIG. 16 is a diagram showing a relationship between the rotational angle of the position adjustment member shown in FIG. 14A, FIG. 14B and a displacement of the nozzle hole.

FIG. 16 shows a relationship between the rotational angle (rad) of the position adjustment member 412 and the displacement (μm) in the X-Y plane of the nozzle hole 401H. As shown in the drawing, the displacement of the nozzle hole 401H corresponds to the rotational angle of the position adjustment member 412, and increases as the rotational angle of the position adjustment member 412 increases. Specifically, by making the part long in distance from the rotational center C of the eccentric part 4122 have contact with the reference surface SS, the displacement of the base plate 41, and by extension, the displacement of the nozzle hole 401H increases. As described above, the displacement of the nozzle hole 401H and an amount of rotation of the position adjustment member 412 are in a proportional relationship. Thus, it is possible to easily calculate the displacement of the nozzle hole 401H from the amount of rotation of the position adjustment member 412.

It should be noted that when attempting to rotate the position adjustment member 412 counterclockwise on the sheet of FIG. 14A, FIG. 14B, the rotation restriction part 4122*r* of the position adjustment member 412 (the eccentric part 4122) engages with the engaging part E of the bottomed hole Ha (see FIG. 8A, FIG. 8B). Thus, a mistake in rotation in the opposite direction of the position adjustment member 412 by the operator is prevented from occurring, and it becomes possible to easily perform the position adjustment of the nozzle holes 401H.

After adjusting the nozzle holes 401H to the desired positions, the screws 46 are inserted in the screw holes 41SH as shown in FIG. 15 to fix the inkjet head 4 to the carriage 33. For example, in such a manner, it is possible to install the inkjet head 4. When installing the plurality of inkjet heads 4 in the carriage 33, it is sufficient to install each of the inkjet heads 4 in the carriage 33 in such a manner. Such installation of the inkjet heads 4 is performed when, for example, manufacturing the printer 1, and replacing the inkjet heads 4.

[Operations and Functions/Advantages]

(A. Basic Operation of Printer 1)

In the printer 1, the recording operation (a printing operation) of images, characters, and so on to the recording paper P is performed in the following manner. It should be noted that as an initial state, it is assumed that the four types of ink tanks 3 shown in FIG. 1 are sufficiently filled with the ink of the corresponding colors (the four colors), respectively. Further, there is achieved the state in which the inkjet heads 4 are filled with the ink in the ink tanks 3.

In such an initial state, when operating the printer 1, the grit rollers 21 in the carrying mechanisms 2*a*, 2*b* each rotate to thereby carry the recording paper P along the carrying direction d (the X-axis direction) while being held between the grit rollers 21 and the pinch rollers 22. Further, at the same time as such a carrying operation, the drive motor 38 in the drive mechanism 34 rotates each of the pulleys 35, 36 to thereby operate the endless belt 37. Thus, the carriage 33 reciprocates along the width direction (the Y-axis direction) of the recording paper P while being guided by the guide rails 31, 32. Then, on this occasion, the ink is appropriately ejected on the recording paper P by each of the inkjet heads 4 to thereby perform the recording operation of images, characters, and so on to the recording paper P.

(B. Operation in Head Modules 40)

An operation of the head modules 40 will subsequently be described (FIG. 6). In the head module 40, there is formed a flow channel of the ink 9 extending from the introduction port 44 toward the discharge port 45, and at the same time, there are disposed the nozzle holes 401H (discharge openings) in the flow channel. In the flow channel of the ink 9, when the ink 9 is supplied from the introduction port 44 to the flow channel, the ink 9 flows from the introduction port 44 toward the discharge port 45, and at the same time, a part of the ink 9 is discharged from the nozzle holes 401H to the outside as needed (when performing the recording).

(C. Functions/Advantages)

In the present embodiment, the positioning areas 41R are each disposed inside the outer circumferential edge 41E. More specifically, the position adjustment member 412 and the biasing member 413 are disposed inside the hole part H of the base plate 41. The biasing member 413 disposed in the hole part H in the positioning area 41R biases the position adjustment member 412, and due to the reaction of the biasing force, the base plate 41 is biased by the carriage 33. Thus, the rough positions in the X-Y plane of the nozzle holes 401H with respect to the carriage 33 are set. Further, by operating the position adjustment member 412 on the reference surface SS disposed inside the hole part H (the bottomed hole Ha) of the base plate 41, the positions in the X-Y plane of the base plate 41 and the head modules 40 with respect to the carriage 33 change. In other words, the positions of the nozzle holes 401H (the nozzle array) with respect to the carriage 33 are adjusted.

In the inkjet head 4, the position adjustment member 412 and the biasing member 413 are disposed in the positioning area 41R, more specifically the hole part H, located inside the outer circumferential edge 41E of the base plate 41. In other words, the members for setting the rough positions in the X-Y plane of the nozzle holes 401H with respect to the carriage 33 are disposed inside the outer circumferential edge 41E of the base plate 41, specifically inside the hole part H of the base plate 41. Thus, the occupied area by the inkjet head 4 becomes smaller compared to when disposing the members for setting the rough positions in the X-Y plane of the nozzle holes 401H with respect to the carriage 33 outside the outer circumferential edge 41E of the base plate 41. Therefore, it becomes possible to reduce the area necessary to install the inkjet head 4. Further, due to the reduction in the installation area for the inkjet head 4, it becomes possible to arrange the plurality of inkjet heads 4 in the carriage 33 at high density.

In this inkjet head 4, the reference surface SS with which the position adjustment member 412 is made to have contact is further disposed inside the hole part H, and by pressing the position adjustment member 412 against the reference surface SS, the positions in the X-Y plane of the nozzle holes 401H with respect to the carriage 33 are adjusted with high accuracy. In other words, due to the position adjustment member 412 disposed inside the hole part H, it is possible to adjust the positions in the X-Y plane of the nozzle holes 401H with respect to the carriage 33 with high accuracy. Therefore, the occupied area by the inkjet head 4 becomes smaller compared to when disposing the members for adjusting the positions of the nozzle holes 401H outside the outer circumferential edge 41E of the base plate 41. Therefore, in the inkjet head 4, it becomes possible to dispose the nozzle holes 401H with high accuracy, and at the same time, to reduce the installation area for the inkjet head 4.

Further, it is preferable for the positioning areas 41R to be disposed outside the head modules 40 along the arrangement direction (hereinafter referred to as a nozzle array direction; the X-axis direction in this case) of the nozzle holes 401H. Thus, it is easy to reduce the occupied area by the inkjet head 4 in the direction (the Y-axis direction) crossing the nozzle array direction. It becomes possible to dispose the plurality of inkjet heads 4 at higher density on the carriage 33 by reducing the occupied area by the inkjet head 4 in the direction crossing the nozzle array direction rather than by reducing the occupied area of the inkjet head 4 in a direction parallel to the nozzle array direction. This point will hereinafter be described.

For example, when the plurality of inkjet heads 4 are disposed on the carriage 33 as shown in FIG. 2 and FIG. 3, if the area where the nozzle arrays of the respective inkjet heads 4 arranged in the Y-axis direction overlap each other becomes excessively large, the nozzle holes 401H from which no ink is ejected increases, and therefore, the productivity drops. Therefore, even when reducing the occupied area by the inkjet head 4 in the X-axis direction, it becomes difficult to increase the density of the inkjet heads 4 arranged in the X-axis direction due to the restriction of the area where the nozzle arrays overlap each other. In contrast, since there is no such restriction of the area where the nozzle arrays overlap each other as described above between the inkjet heads 4 arranged in the Y-axis direction, it is possible to effectively increase the density of the inkjet heads 4 arranged in the Y-axis direction by reducing the occupied area by the inkjet head 4 in the Y-axis direction.

Further, it is preferable for the positioning areas 41R to be disposed in the both end parts in the nozzle array direction of the base plate 41. Thus, it is possible to rotate the other positioning area 41R around the one positioning area 41R as a pivot, and to rotate the one positioning area 41R around the other positioning area 41R as a pivot as described above. Therefore, it becomes possible to more freely adjust the angle and the position of the base plate 41, and by extension, the angle of the nozzle array direction and the position of the nozzle array, compared to when disposing the positioning area 41R only in one of the end parts in the nozzle array direction of the base plate 41.

As described above, in the inkjet head 4 and the printer 1 according to the present embodiment, since it is arranged that the position adjustment member 412 and the biasing member 413 in the hole part H, it is possible to reduce the occupied area by the inkjet head 4 compared to when disposing the members for performing the positioning of the nozzle holes 401H outside the outer circumferential edge 41E of the base plate 41. Therefore, it becomes possible to reduce the area necessary to install the inkjet head 4. Further, due to the position adjustment member 412 disposed inside the hole part H, it is possible to adjust the positions in the X-Y plane of the nozzle holes 401H with respect to the carriage 33 with high accuracy.

2. Other Modified Examples

The present disclosure is described hereinabove citing some embodiments, but the present disclosure is not limited to these embodiments and so on, and a variety of modifications can be adopted.

For example, in the embodiment described above, the description is presented specifically citing the configuration examples (the shapes, the arrangements, the number and so on) of each of the members in the printer, the inkjet head and the head chip, but what is described in the above embodiment is not a limitation, and it is possible to adopt other shapes, arrangements, numbers and so on.

Further, although in the embodiment described above, there is described when disposing the positioning areas 41R in the both end parts in the long-side direction of the base plate 41, it is also possible to arrange that the positioning area 41R is disposed in one end part in the long-side direction of the base plate 41. Alternatively, it is sufficient for the positioning area 41R to be disposed inside the outer circumferential edge 41E of the base plate 41, and it is also possible for the positioning area 41R to be disposed in an end part in the short-side direction of the base plate 41.

Further, although in the embodiment described above, the description is presented citing when the "biased member" in the present disclosure is the position adjustment member 412 as an example, it is also possible to arrange that the "biased member" in the present disclosure is formed of other members. For example, the "biased member" in the present disclosure can be formed of a pin not provided with the eccentric part 4122. In this case, the biasing member 413 biases the pin, and due to the reaction of the biasing force, the base plate 41 is biased toward the carriage 33. Thus, the protruding stoppers 411A, 411B of the base plate 41 are made to have contact with the predetermined portions of the carriage 33, and the positions in the X-Y plane of the nozzle holes 401H with respect to the carriage 33 are set. When the position adjustment with high accuracy of the nozzle holes 401H with respect to the carriage 33 is unnecessary, namely when the printer 1 can sufficiently be used providing the positions of the nozzle holes 401H with respect to the carriage 33 are roughly set, it is possible to use the pin or the like as the "biased member." The high accuracy is not required for such a "biased member" not provided with the position adjustment function compared to the "biased member" having the position adjustment function. Therefore, it becomes possible to more easily achieve the positioning of the inkjet head 4 with respect to the carriage and the reduction of the area necessary to install the inkjet head 4.

Further, the printer 1 can be provided with an ink circulation mechanism for circulating the ink between the ink tank 3 and the inkjet head 4, or can be provided with an inkjet head 4 of a non-circulation type in which the ink is not circulated.

Further, the actuator plate 402 can be a chevron type actuator plate in which two piezoelectric substrates different in polarization direction from each other are stacked on one another, or can also be a cantilever type actuator plate. The cantilever-type actuator plate is formed of a single piezoelectric substrate having the polarization direction set to one direction along the thickness direction.

Further, the inkjet head 4 can be an edge-shoot type inkjet head, or can also be a side-shoot type inkjet head.

Further, although in the embodiment described above and so on, there is described when the printer 1 performs recording with a shuttle method, it is also possible for the printer 1 to be arranged to perform the recording with other method such as a one-pass method. The shuttle method is a method in which the inkjet head 4 moves to perform the recording, and the one-pass method is a method in which the recording medium moves in one direction to perform the recording.

Further, in the embodiment and so on described above, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head 4) of the present disclosure is applied to other devices than the inkjet printer. Specifically, for example, it is also possible to arrange that the "liquid jet head" of the present disclosure is applied to a device such as a facsimile or an on-demand printer.

It should be noted that the advantages described in the specification are illustrative only but are not a limitation, and other advantages can also be provided.

Further, the present disclosure can also take the following configurations.

<1> A liquid jet head to be installed in a carriage of a liquid jet recording device, the liquid jet head comprising: a jet section provided with a nozzle hole configured to jet liquid; a support member configured to support the jet section, and provided with a hole part including a through hole penetrating in a jet direction of the liquid; a biasing member disposed in the hole part, and configured to bias the support member toward the carriage; and a biased member which is disposed at a predetermined position with respect to the carriage, and is biased in the hole part by the biasing member to thereby set a position of the nozzle hole with respect to the carriage.

<2> The liquid jet head according to <1>, further comprising: a reference surface which is disposed inside the hole part, and with which the biased member is made to have contact, wherein the biased member is a position adjustment member configured to adjust the position of the nozzle hole with respect to the carriage.

<3> The liquid jet head according to <2>, wherein the position adjustment member is an eccentric cam including an eccentric part including a part having contact with the reference surface, and a first shaft part pivotally supported by a shaft hole provided to the carriage.

<4> The liquid jet head according to <3>, wherein the position adjustment member includes a second shaft part which is disposed on an opposite side to the first shaft part across the eccentric part, and is pivotally supported by the shaft hole provided to the carriage.

<5> The liquid jet head according to <3> or <4>, wherein a displacement of the nozzle hole corresponds to an amount of rotation of the position adjustment member.

<6> The liquid jet head according to any one of <3> to <5>, wherein the eccentric part includes an initial part having a first distance from a rotational center thereof; and a rotation restriction part which is disposed adjacent to the initial part, and has a second distance longer than the first distance from the rotational center, the second distance is longer than a distance from a position corresponding to the rotational center of the hole part to the reference surface, and the hole part is provided with an engaging part which is engaged with the rotation restriction part to thereby restrict the rotation in one direction of the position adjustment member.

<7> The liquid jet head according to any one of <1> to <6>, wherein the biased member is inserted in the hole part, and is pivotally supported by a shaft hole provided to the carriage in a rotatable manner.

<8> The liquid jet head according to any one of <1> to <7>, wherein a plurality of the nozzle holes are arranged along a predetermined direction in the jet section, the support member has a positioning area outside the jet part in the predetermined direction, and the hole part is disposed in the positioning area.

<9> The liquid jet head according to <8>, wherein the support member has the positioning areas on both sides in the predetermined direction.

<10> The liquid jet head according to anyone of <1> to <9>, wherein the biasing member is formed of a wire spring.

<11> A liquid jet recording device comprising: the liquid jet head according to anyone of <1> to <10>; and the carriage on which the liquid jet head is mounted.

What is claimed is:

1. A liquid jet head to be installed in a carriage of a liquid jet recording device, the liquid jet head comprising:

a jet section provided with a nozzle hole configured to jet liquid;

a support member configured to support the jet section, and provided with a hole part including a through hole penetrating in a jet direction of the liquid;

a biasing member disposed in the hole part, and configured to bias the support member toward the carriage; and a biased member which is disposed at a predetermined position with respect to the carriage, and is biased in the hole part by the biasing member to thereby set a position of the nozzle hole with respect to the carriage; and a reference surface which is disposed inside the hole part, and with which the biased member is made to have contact, wherein the biased member is a position adjustment member configured to adjust the position of the nozzle hole with respect to the carriage, and wherein the position adjustment member is an eccentric cam including an eccentric part including a part having contact with the reference surface, and a first shaft part pivotally supported by a shaft hole provided to the carriage.

2. The liquid jet head according to claim 1, wherein the position adjustment member includes a second shaft part which is disposed on an opposite side to the first shaft part across the eccentric part, and is pivotally supported by the shaft hole provided to the carriage.

3. The liquid jet head according to claim 1, wherein a displacement of the nozzle hole corresponds to an amount of rotation of the position adjustment member.

4. The liquid jet head according to claim 1, wherein the eccentric part includes:

an initial part having a first distance from a rotational center thereof; and a rotation restriction part which is disposed adjacent to the initial part, and has a second distance longer than the first distance from the rotational center, the second distance is longer than a distance from a position corresponding to the rotational center of the hole part to the reference surface, and the hole part is provided with an engaging part which is engaged with the rotation restriction part to thereby restrict the rotation in one direction of the position adjustment member.

5. The liquid jet head according to claim 1, wherein the biased member is inserted in the hole part, and is pivotally supported by a shaft hole provided to the carriage in a rotatable manner.

6. The liquid jet head according to claim 1, wherein a plurality of the nozzle holes are arranged along a predetermined direction in the jet section, the support member has a positioning area outside the jet part in the predetermined direction, and the hole part is disposed in the positioning area.

7. The liquid jet head according to claim 6, wherein the support member has the positioning areas on both sides in the predetermined direction.

8. The liquid jet head according to claim 1, wherein the biasing member is formed of a wire spring.

9. A liquid jet recording device comprising:

the liquid jet head according to claim 1; and the carriage on which the liquid jet head is mounted.

* * * * *